United States Patent [19]

Cole

[11] Patent Number: 4,811,312

[45] Date of Patent: Mar. 7, 1989

[54] TIMER WITH IMPROVED CLUTCH AND METHOD OF MANUFACTURING THE SAME

[75] Inventor: Ronald E. Cole, Greenwood, Ind.

[73] Assignee: Emhart Industries, Inc., Indianapolis, Ind.

[21] Appl. No.: 223,004

[22] Filed: Jul. 22, 1988

[51] Int. Cl.[4] ..... G04F 3/06; H01H 43/10

[52] U.S. Cl. ..... 368/107; 368/191; 200/38 R

[58] Field of Search ..... 368/107–113, 368/185, 190–195, 250, 254; 200/35 R, 78 R, 38 F, 38 FA, 38 B, 38 D

[56] References Cited

U.S. PATENT DOCUMENTS

| | | | |
|---|---|---|---|
| 3,742,159 | 6/1973 | Brown | 200/38 R |
| 3,780,240 | 12/1973 | Stafford et al. | 200/38 R |
| 3,837,161 | 9/1974 | Huntrich | 368/191 |
| 3,930,362 | 1/1976 | Cielasztr | 368/191 |
| 4,182,112 | 1/1980 | Strachan | 368/108 |
| 4,203,014 | 5/1980 | Harris | 300/38 R |
| 4,490,589 | 12/1984 | Voland | 200/38 R |

*Primary Examiner*—Vit W. Miska

*Attorney, Agent, or Firm*—Carl A. Forest

[57] ABSTRACT

A timer includes a cam driven by a motor and a clutch for permitting the cam to be turned independently of the motor. The clutch includes a clutch plate having a toothed rim, the plate sandwiched between a pair of spring washers, and a tubular eyelet passing through openings in the plate and washers. The clutch assembly is placed on a mandrel and the washers are spun while the teeth on the plate engage a force gauge. The end of the eyelet is flared to fasten the clutch assembly together with a force which provides a predetermined torque between the plate and washer as measured by the force gauge.

9 Claims, 3 Drawing Sheets

FIG. 1
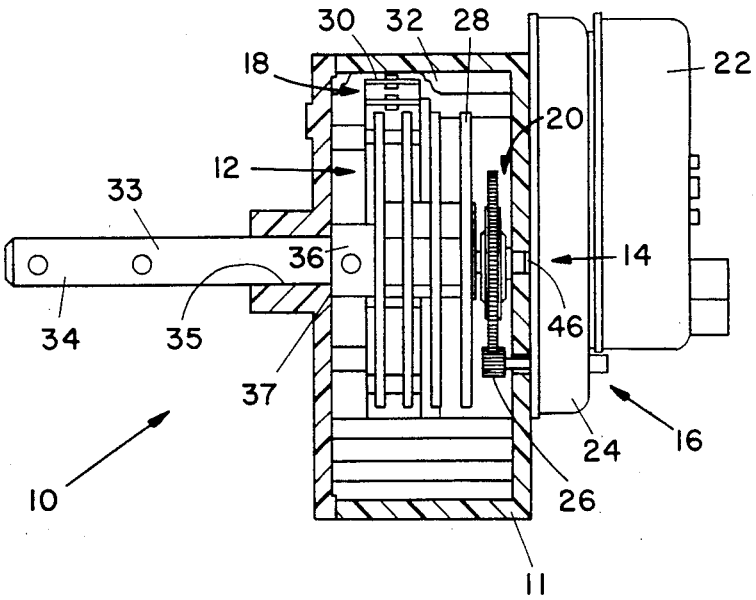
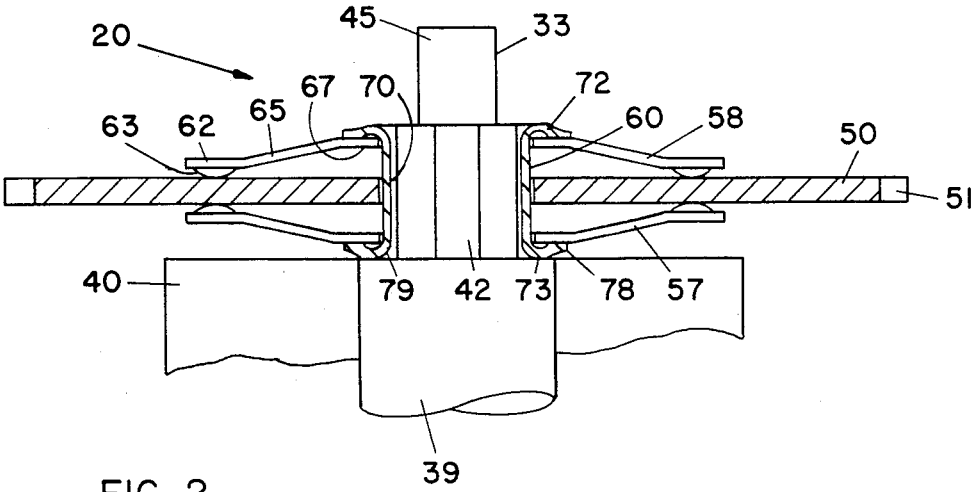
FIG. 2
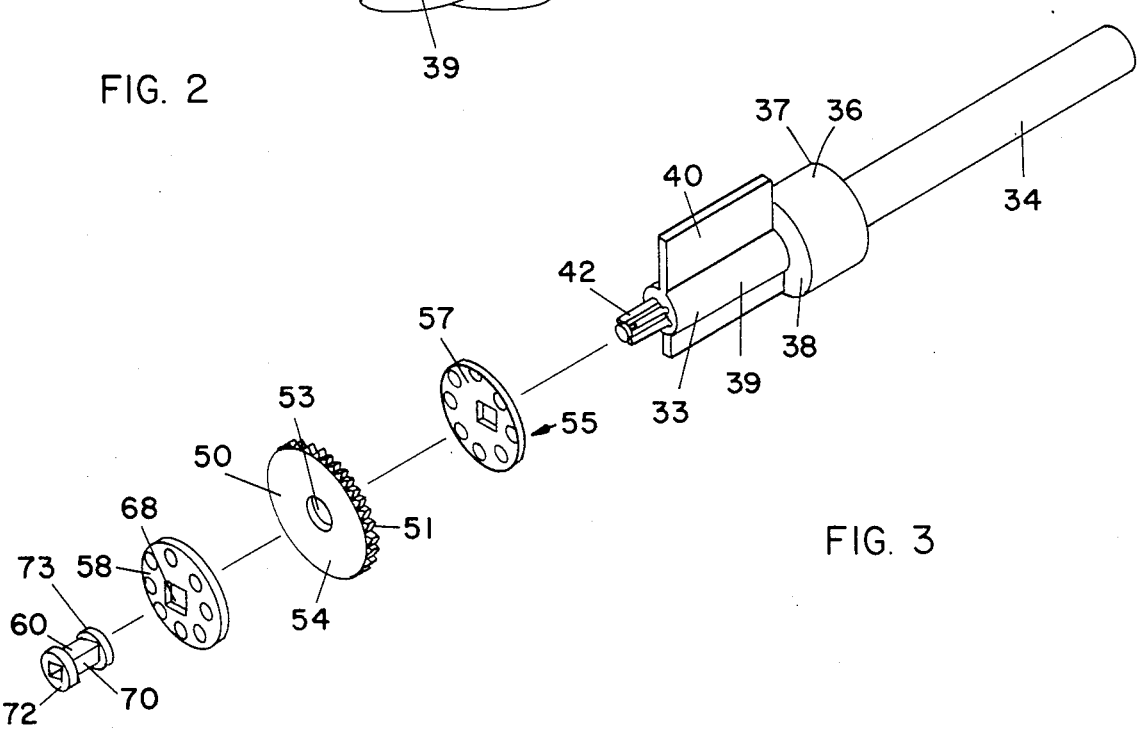
FIG. 3

TIMER WITH IMPROVED CLUTCH AND METHOD OF MANUFACTURING THE SAME

BACKGROUND OF THE INVENTION

1. Field of the Invention

The present invention in general relates to appliance timers and more particularly to the clutch mechanism of such timers.

2. Description of Prior Art

Electromechanical timers have been known as long as automatic appliances. A common form of such a timer includes a motor, a gear train, a camstack driven by the motor and gear train, and switches which are opened and closed by cams on the camstack to operate a programmed sequence of appliance functions. Generally it is desirous in such timers to be able to manually set the camstack to a desired program cycle. During such manual setting the camstack is turned at a much higher rate of speed than it is when driven by the motor and gear train. To enable the camstack to be turned easily and to prevent damage to the motor and gear train, it is desirable to place a friction clutch between the gear train and camstack. For more than two decades, a standard clutch for such purposes has comprised a clutch plate integrally formed with a large gear sandwiched between two dimpled spring washers. See, for example, the clutch disclosed in U.S. Pat. No. 3,500,005 issued to W. R. Brown. The connection between the cam drive shaft and the clutch spring washers is critical in such a timer, and thus these parts are conventionally made of stainless steel and the drive shaft is staked to the spring washers. The steel shaft is a screw machined part and relatively expensive compared to other materials generally used in timers and more difficult to manufacture than other materials. Thus, a timer clutch that is reliable as prior art clutches in combination with a drive shaft that is made of die cast zinc, zinc alloy, or other moldable material which is relatively inexpensive and easily manufactured would be of significant advantage.

SUMMARY OF THE INVENTION

It is an object of the invention to provide a timer with a cam drive mechanism that is less expensive to manufacture than prior art cam drive mechanisms.

It is a further object of the invention to provide the above object in a timer that is at least as reliable as prior art timers.

It is another object of the invention to provide a method of manufacturing a timer clutch that is relatively inexpensive.

It is yet another object of the invention to provide the above object in a manufacturing process in which the manufacturing tolerances are at least as controllable as in the prior art manufacturing methods.

It is still another object to provide one or more of the above objects with a manufacturing process that is relatively easy to automate.

The invention provides a timer comprising: a support; cam means for providing a programmed sequence of camming actions; means for rotatably mounting the cam means in said support; drive means for driving the cam means; switch means responsive to the cam means for performing a timing function; and clutch means for permitting the cam means to be rotated independently of the drive means, the clutch means comprising: a clutch plate having an opening in it; spring washer means for frictionally engaging the clutch plate, the washer means having an opening therein; and an eyelet passing through the openings in the plate and the washer means, at least one end of the eyelet flared to a diameter larger than the diameter of the opening in the washer means to hold the plate and washer means together with a force which provides a predetermined frictional torque between the plate and washer means. Preferably the opening in the washer means is substantially square and the eyelet comprises a square-barreled eyelet. Preferably, the means for rotatably mounting the cam means comprises a drive shaft passing through and engaging the eyelet, and the drive shaft is made of a relatively easily formable material, such as zinc. Preferably, the drive shaft is knurled in the area where it engages said eyelet. Preferably, the knurl in the drive shaft comprises a four-sectioned straight knurl. In another aspect, the invention provides a method of manufacturing a timer clutch comprising the steps of: providing a clutch plate having an opening in it, two spring washers, each having an opening in it, and a tubular eyelet; placing the clutch plate between the spring washers and passing the eyelet through the openings; flaring at least one end of the eyelet to fasten the plate and washers together while turning the plate with respect to the washers and measuring the torque on the plate; stopping the flaring when the magnitude of the torque reaches a predetermined value. Preferably the step of providing comprises providing an eyelet with one end pre-flared. Preferably the eyelet comprises a square-barreled eyelet and the opening in the clutch plates are substantially square. Preferably the step of providing comprises providing a clutch plate integrally formed with a gear and providing a force gauge having a toothed actuator, and the step of measuring comprises engaging the gear with the toothed actuator.

The timer, clutch and method of the invention not only provides a less expensive timer, but one in which the tolerances are much more controllable and the timer more durable even though the drive shaft is made with inherently less durable material. In fact, the dynamic torque of the clutch can be precisely adjusted to predetermined values rather than being a distributed function of the manufacturing process. Numerous other features, objects and advantages of the invention will become apparent from the following detailed description when read in conjunction with the accompanying drawings.

BRIEF DESCRIPTION OF THE DRAWINGS

In the drawings:

FIG. 1 is a partially cross-sectioned side view of the preferred embodiment of the timer according to the invention;

FIG. 2 is an enlarged cross-sectional view of the preferred embodiment of the timer clutch of FIG. 1 on the end of the drive shaft of FIG. 1;

FIG. 3 is a perspective exploded view of the clutch and cam drive shaft of FIG. 1;

DESCRIPTION OF THE PREFERRED EMBODIMENT

Figure 4A:
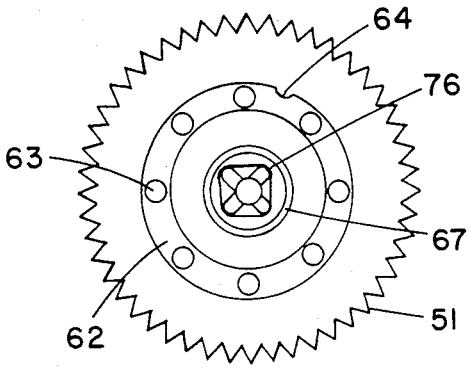
FIGS. 4A and 4B show the front and back views of the timer clutch of FIG. 1.
Figure 4B:
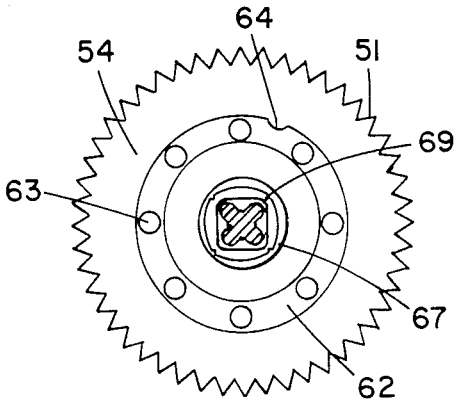

The preferred embodiment of a timer according to the invention is shown in FIG. 1. The timer 10 includes a support comprising a housing 11, a cam means 12 for providing a programmed sequence of camming actions, a means 14 for rotatably mounting the cam means 12 in the support 11, drive means 16 for driving the cam means 12, switch means 18 responsive to the cam means 12 for performing a timing function, and clutch means 20 for permitting the cam means 12 to be rotated independently of the drive means 16. The drive means includes a motor 22 and a gear train within a gear box 24, and an output drive pinion 26, and is conventional. Thus it will not be discussed further herein. The cam means 12 includes four cams such as 28, and switch means 18 includes several switches, such as 30. A portion of housing ribs 32 are cut away to show the switch 30. The cam means 12 and switch means 18 are also conventional and thus won't be discussed further herein. Means 14 for rotatably mounting the cam means 12 includes a drive shaft 33. It is understood that the particular embodiment shown of the timer 10 including the clutch means 20, is by way of example only and is not intended to be limiting of the invention.

Turning now to a more detailed description of the invention, the drive shaft 33 is shown in FIGS. 1–3. It is preferably an integrally cast or molded piece and includes a proximal cylindrical portion 34 to which a knob (not shown) may be attached to manually turn it and which fits into a bearing bore 35 in housing 11 to rotatably support the cam means 12 and clutch means 20 assembly in the housing 11. A larger diameter cylindrical portion 36 provides a shoulder 37 to locate the drive shaft in the housing and a shoulder 38 to locate the cam means 12, an intermediate portion 39 which has a two-bladed key 40 attached, which key 40 fits into a conventional key way in the cam means 12 to transfer the rotational motion of the drive shaft 33 to the cam means 12, a knurled portion 42 which connects to the clutch means 20 and shall be discussed in detail below, and a distal cylindrical portion 45 which fits into a bearing bore 46 in housing 11 to rotatably support the cam means and clutch means 20 assembly in the housing 11.

The clutch means 20 preferably comprises a clutch plate 50 and a spring washer means 55 for frictionally engaging the clutch plate 50, the means 55 preferably comprising a first spring washer 57 and a second spring washer 58; clutch means 20 also preferably comprises eyelet 60. Clutch plate 50 is disk-shaped, preferably has gear teeth 51 formed in its outer edge, and has a circular opening 53 in its center. Spring washer 58 is preferably a concave disk having a circular rim 62 having dimples, such as 63, formed on it, a sloping intermediate portion 65 and a circular central portion 67 having an opening 68 in it. Opening 68 is preferably substantially square; i.e., square in cross-section with rounded corners or vertices such as 69. A notch 64 is formed in its rim 62. Spring washer 57 is identical to spring washer 58. Eyelet 60 preferably comprises a barrel 70 with its ends flared to form a first flange 72 and a second flange 73. Barrel 70 is preferably substantially square, i.e. it is square in cross-section with rounded corners or vertices such as 76. Its interior diameter is such that it fits snugly on knurled portion 42 of shaft 33 and its outer diameter is such that openings 68 of washers 57 and 58 fit snugly on it. Opening 53 of plate 50 is such that plate 53 turns freely on the four radiused vertices of barrel 70 of eyelet 60. In the embodiment shown, flanges 72 and 73 are formed so that their outer rims are flat against inner rim 67 of washers 57 and 58; however, they may also be formed so they contact rim 67 of the washers only at the outer tip, such as 78, and/or the inner curve such as 79. Either type of flange is suitable, however the form shown is preferable as it distributes the strain more evenly. Washers 57 and 58 are oriented so that their concave faces face toward each other and the dimples, such as 62, contact the central flat portion 54 of plate 50. As can best be seen in FIG. 2, the flanges 72 and 73 have a diameter larger than the diameter of opening 68 in washers 57 and 58 and the flanges are flared, as shall be described below, to compress washers 57 and 58 against plate 50, thereby holding the plate 50 and washer means 55 together with a force which provides a frictional torque between the plate 50 and the washer means 55 within a predetermined range.

Figure 5:
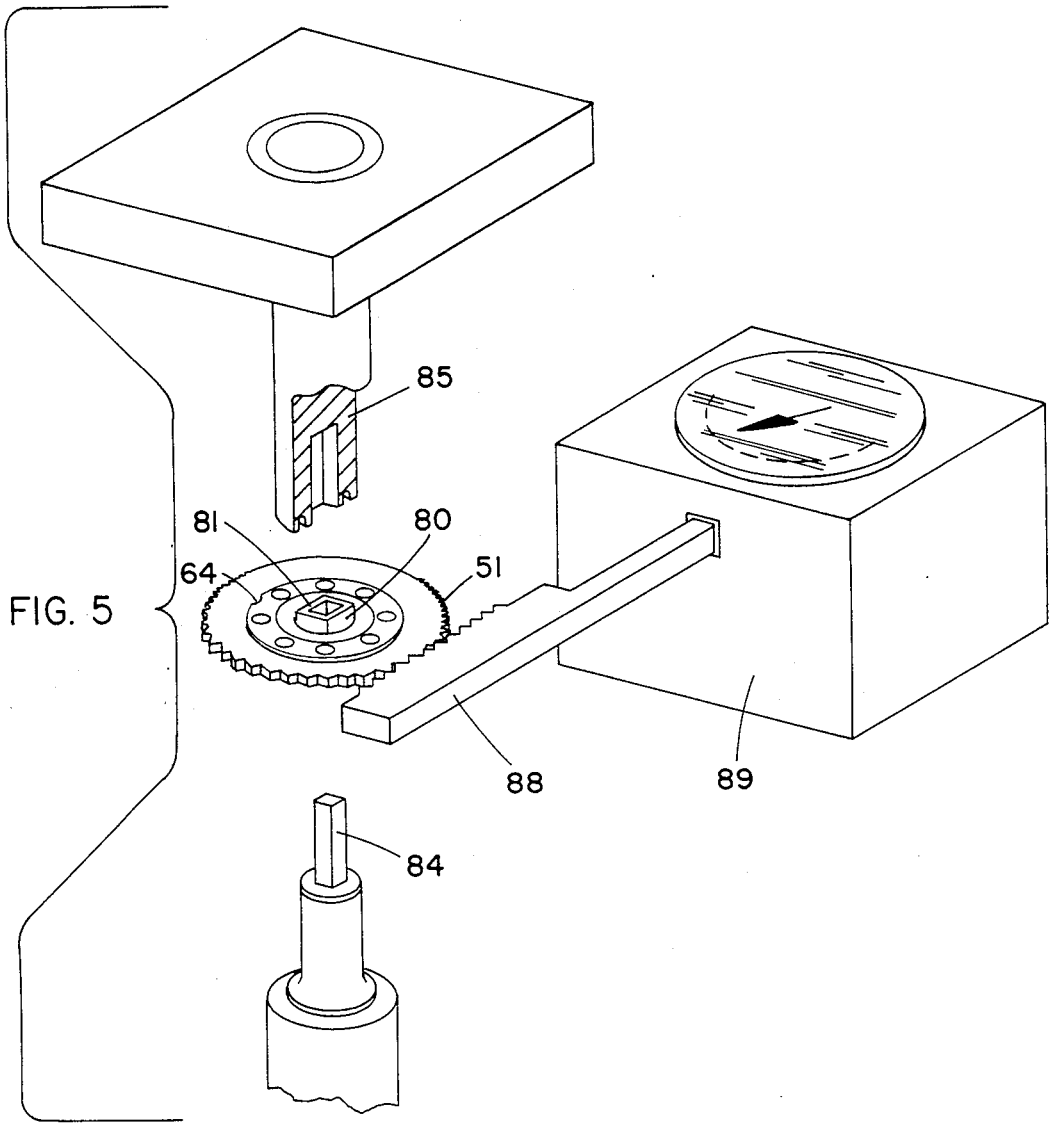
FIG. 5 a representation of the principal elements of the preferred embodiment of the manufacturing method according to the invention.

The method of manufacturing the clutch means 20 to obtain the torque within the predetermined range is shown in FIG. 5. The clutch plate 50 is placed between the spring washers 57 and 58, and an eyelet 80 with one end 81 not flared is inserted through the openings 68 in the washers and 53 in the plate. Notch 64 is used to locate the washers 57 and 58 with respect to the eyelet 80. This assembly is placed on a mandrel 84 and a flare forming member 85 is pressed against the end 81 as the mandrel 84, eyelet 80, washers 57 and 58 and member 85 are rotated. A toothed actuator arm 88 of a force gauge 89 engages the teeth 51 of plate 50 to hold it still and to measure the force provided by the above-discussed frictional engagement of the plate 50 and the washers 57 and 58. This measured force times the fixed normal distance to the center of rotation is equivalent to the dynamic torque on the plate as is well known. The flaring action of the member 85 is stopped when the dynamic torque reaches a predetermined desired value. Because of the variances in the process, the actual values of static torque obtained may be in a range about the predetermined cut off value of dynamic torque. A typical value obtained is a dynamic torque of 46 ounce inches and a range of less than 4 ounce inches. Dynamic torque means that the torque was measured with the washers 57 and 58 slipping on plate 50. Dynamic torques are used because they are less dependent on preconditioning (temperatures, etc.) and therefore more repeatable than static torques.

The method as described obtains the clutches as described above; the flanges 72 and 73 may be flattened more or less than shown in FIG. 2 depending on the torque values to which the flaring is done.

In the preferred embodiment, eyelet 80 is a square-barreled eyelet with a rolled flange as may be purchased from Stimpson, Inc., 900 Sylvan Avenue, Bayport, N.Y. 11705–1097. A size between the Stimpson A905 and A1570 sizes is preferable. It is preferably made of 0.010 inch brass. The outside diameter of barrel 70 is preferably 0.158 inches square while the inside diameter of opening 68 in washers 57 and 58 is preferably 0.163 inches square. The diagonal dimension across the radiused vertices of the eyelet 60 is 0.190 inches while the same dimension of the washers is 0.192 inches. The diameter of opening 53 in clutch plate 50 is preferably 0.1945 inches. Knurled portion of shaft 42 is preferably a four-sectioned straight knurl. Drive shaft 33 is preferably die cast zinc alloy. Plate 50 and washers 57 and 58 are made out of stainless steel with the plate 50 being about 0.032 inches thick and washers 57 and 58 being about 0.010 inches thick. Dimples, such as 63 are about 0.062 inches in spherical radius and 0.015 inches high. Other materials and dimensions are conventional.

It is a feature of the invention that the timer clutch according to the invention can be turned to the specific torque desired. Differing torques are required for different timer functions or are preferred by different appliance manufacturers. In the prior art, clutches with different torques were randomly made by a staked height manufacturing process and after manufacture they were tested and sorted to various dynamic torque ranges about the desired range. The dynamic torque sorting of the prior art clutches is typically in 16 ounce inch ranges. In the process of the invention they are made to a predetermined dynamic torque value and variances result in a range of static torque values about the correlating desired value. The accuracy of dynamic torque cut off is within a 4 ounce inches range. This process results in less scrap and the ability to manufacture to closer specification.

Another feature of the invention is that the torques stay within a narrower range over the lifetime of the product. This is important because if torques fall below a minimum torque, the timer can be accidentally set or turned which could result in unsafe operation. This is shown in Table 1.

TABLE 1

| Clutch cycles | | 0 | 2,000 | 4,000 | 6,000 | 8,000 | 10,000 |
|---|---|---|---|---|---|---|---|
| | | STATIC TORQUE | | | | | |
| TEST | MEAN | 54 | 32 | 28 | 28 | 24 | 21 |
| | STD. DEV. | 6 | 7 | 5 | 3 | 4 | 5 |
| CONTROL | MEAN | 55 | 30 | 27 | 30 | 22 | 18 |
| | STD. DEV. | 7 | 9 | 9 | 5 | 5 | 4 |
| | | MINIMUM TORQUE | | | | | |
| TEST | | 48 | 25 | 23 | 25 | 20 | 16 |
| CONTROL | | 48 | 21 | 18 | 25 | 17 | 14 |
| | | RANGE | | | | | |
| TEST | | 12 | 14 | 10 | 6 | 8 | 10 |
| CONTROL | | 14 | 18 | 18 | 10 | 10 | 8 |

Table 1 shows the results of testing clutches manufactured to a dynamic torque of 46 ounce inches. The static torque relates to the actual safety, setting and efficient running of the timers. The test group was for clutches according to the invention and the control group were prior art clutches which were made with steel shafts which were staked to fasten the clutch assemblies. Both groups began with the same minimum static torque required for the particular mission profile, i.e. 48 ounce inches initially. In order that the test be statistically valid and to reflect life profiles over the board range encompassed by varying market applications, clutches of the test group were purposely manufactured to the broad range of the prior art control group. The groups were tested new and at the end of 2,000, 4,000, 6,000, 8,000 and 10,000 clutch cycles. As the test progressed, the minimums for the test group stayed higher or as high as the control group while the deviations remained lower. This test indicates that the timers according to the invention are more durable and less erratic than the prior art timers.

A novel timer and method of manufacturing a timer clutch which result in timers which are both less expensive and more durable and have numerous other features and advantages has been described. It is evident that those skilled in the art may now make many uses and modifications of the specific embodiment described without departing from the inventive concepts. Consequently the invention is to be construed as embracing each and every novel feature and novel combination of features present in the timer and method of manufacturing described.

What is claimed is:

1. A timer comprising:

a support;

cam means for providing a programmed sequence of camming actions;

means for rotatably mounting said cam means in said support;

drive means for driving said cam means;

switch means responsive to said cam means for performing a timing function; and clutch means for permitting said cam means to be rotated independently of said drive means, said clutch means comprising:

a clutch plate having an opening in it;

spring washer means for frictionally engaging said clutch plate, said washer means having an opening therein; and an eyelet passing through said openings in said plate and said washer means, at least one end of said eyelet flared to a diameter larger than the diameter of the opening in said washer means to hold said plate and washer means together with a force which provides a predetermined frictional torque between said plate and said washer means.

2. A timer as in claim 1 wherein said opening in said washer means is substantially square and said eyelet comprises a square-barreled eyelet.

3. A timer as in claim 1 wherein said means for rotatably mounting said cam means comprises a drive shaft passing through and engaging said eyelet, said drive shaft made of a relatively easily castable material, such as zinc.

4. A timer as in claim 3 wherein said drive shaft is knurled in the area where it engages said eyelet.

5. A timer as in claim 4 wherein said knurl in said drive shaft comprises a four-sectioned straight knurl.

6. A method of manufacturing a timer clutch comprising the steps of:

providing a clutch plate having an opening in it, two spring washers, each having an opening in it, and a tubular eyelet;

placing said clutch plate between said spring washers and passing said eyelet through said openings; flaring at least one end of said eyelet to fasten said plate and washers together while turning said plate with respect to said washers and measuring the torque on said plate;

stopping said flaring when the magnitude of said torque reaches a predetermined value.

7. A method of manufacturing a timer clutch as in claim 6 wherein said step of providing comprises providing an eyelet with one end pre-flared.

8. A method as in claim 6 wherein said eyelet comprises a square-barreled eyelet and said opening in said clutch plates are substantially square.

9. A method of manufacturing a timer clutch as in claim 6 wherein said step of providing comprises providing a clutch plate integrally formed with a gear and providing a force gauge having a toothed actuator, and said step of measuring comprises engaging said gear with said toothed actuator.

* * * * *